United States Patent [19]

Gerchow et al.

[11] Patent Number: 4,809,651

[45] Date of Patent: Mar. 7, 1989

[54] VALVE TAPPET APPARATUS

[76] Inventors: James R. Gerchow, 64177 Rommel Rd., Sturgis, Mich. 49091; Dennis K. Russell, 8297 Shallow Glen Trail, Cordova, Tenn. 38018

[21] Appl. No.: 176,946

[22] Filed: Apr. 4, 1988

[51] Int. Cl.[4] ..... F01L 1/14

[52] U.S. Cl. ..... 123/90.5

[58] Field of Search ..... 123/90.5, 904 D; 74/569

[56] References Cited

U.S. PATENT DOCUMENTS

| | | | |
|---|---|---|---|
| 3,108,580 | 10/1963 | Crane | 74/569 |
| 3,180,328 | 4/1965 | Engle | 123/90.5 |
| 3,267,919 | 8/1966 | Wortman | 123/90.5 |
| 4,173,954 | 11/1979 | Speckhart | 123/90.5 |

*Primary Examiner*—Willis R. Wolfe
*Assistant Examiner*—M. Macy
*Attorney, Agent, or Firm*—Walker & McKenzie

[57] ABSTRACT

A valve tappet apparatus including a first tappet body, at least a portion of the first tappet body having a curved outer circumference; a second tappet body, at least a portion of the second tappet body having a curved outer circumference; an elongated, rigid link bar having a first end and a second end; a first attachment mechanism attaching the first end of the link bar to the first tappet body, the first attachment mechanism including a screw for extending through at least a portion of the first tappet body and a nut member for attaching the first end of the link bar to the distal end of the screw, the face surface of the nut member having a concaved portion for engaging a portion of the outer circumference of the first tappet body; and a second attachment mechanism attaching the second end of the link bar to the second tappet body, the second attachment mechanism including a screw for extending through at least a portion of the second tappet body and a nut member for attaching the second end of the link bar to the distal end of the bolt member, the face surface of the nut member having a concaved portion for engaging a portion of the outer circumference of the second tappet body.

15 Claims, 1 Drawing Sheet

VALVE TAPPET APPARATUS

BACKGROUND OF THE INVENTION

1. Field of the Invention

The present invention relates in general to valve tappet assemblies for internal combustion engines.

2. Description of the Related Art

Various valve tappet assemblies have been developed for internal combustion engines. Hydraulic valve tappet assemblies have been developed for engines having relatively low revolutions per minute. See, for example, Vitalini, U.S. Pat. No. 1,965,517; Daisley U.S. Pat. No. 2,116,749; Voorhies, U.S. Pat. No. 2,237,854; Voorhies, U.S. Pat. No. 2,272,074; Meinecke, U.S. Pat. No. 2,484,109; Meinecke, U.S. Pat. No. 2,614,547; Voorhies, U.S. Pat. No. 2,688,318; Williams, U.S. Pat. No. 2,931,347; Wood, U.S. Pat. No. 2,966,151; Lesher, U.S. Pat. No. 3,142,290; Kuchen, U.S. Pat. No. 3,262,434; Cornell, U.S. Pat. No. 3,291,107; Rhoads, U.S. Pat. No. 3,304,925; Donnelly, U.S. Pat. No. 3,406,668; Humphreys, U.S. Pat. No. 3,498,273; Dadd, U.S. Pat. No. 3,516,393; Rhoads, U.S. Pat. No. 3,921,609; Brown, U.S. Pat. No. 3,967,602; and Svihlik, U.S. Pat. No. 4,184,464. Such hydraulic valve tappet assemblies typically have relatively flat cam engaging surfaces which are designed to rotate relative to the valve stems.

Roller valve tappet assemblies have been designed for use with engines having relatively high revolutions per minute. While such roller valve tappet assemblies reduce the valve tappet wear associated with high speed engines, it is desirable to prevent rotation of the roller valve tappet assemblies. Crane, U.S. Pat. No. 3,108,580 discloses a non-rotatable roller valve tappet apparatus which utilizes an alignment bar 26 extending between two adjacent tappets to prevent rotation of the tappets relative to one another and therefore, relative to the longitudinal axis of the valve stem.

The present invention is not disclosed or suggested by the above prior art.

SUMMARY OF THE INVENTION

The present invention is directed toward providing an improved roller valve tappet assembly. More specifically, the present invention provides a valve tappet apparatus for use with an internal combustion engine having a plurality of valve members and a cam means for causing reciprocating movement of the valve members. The apparatus includes, in general, a first tappet body associated with one of the valve members and with the cam means, at least a portion of the first tappet body having a curved outer circumference; a second tappet body associated with another of the valve members and with the cam means, at least a portion of the second tappet body having a curved outer circumference; an elongated, rigid link bar having a first end and a second end; a first attachment means attaching the first end of the link bar to the first tappet body, the first attachment means including a screw member for extending through at least a portion of the first tappet body, the first attachment means including a nut member for attaching the first end of the link bar to the distal end of the bolt member, the nut member having a face side for engaging the outer circumference of the first tappet body, the face surface of the nut member having a concaved portion for engaging a portion of the outer circumference of the first tappet body; and a second attachment means attaching the second end of the link bar to the second tappet body, the second attachment means including a screw member for extending through at least a portion of the second tappet body, the second attachment means including a nut member for attaching the second end of the link bar to the distal end of the bolt member, the nut member having a face side for engaging the outer circumference of the second tappet body, the face surface of the nut member having a concaved portion for engaging a portion of the outer circumference of the second tappet body.

DESCRIPTION OF THE PREFERRED EMBODIMENT

Figure 1:
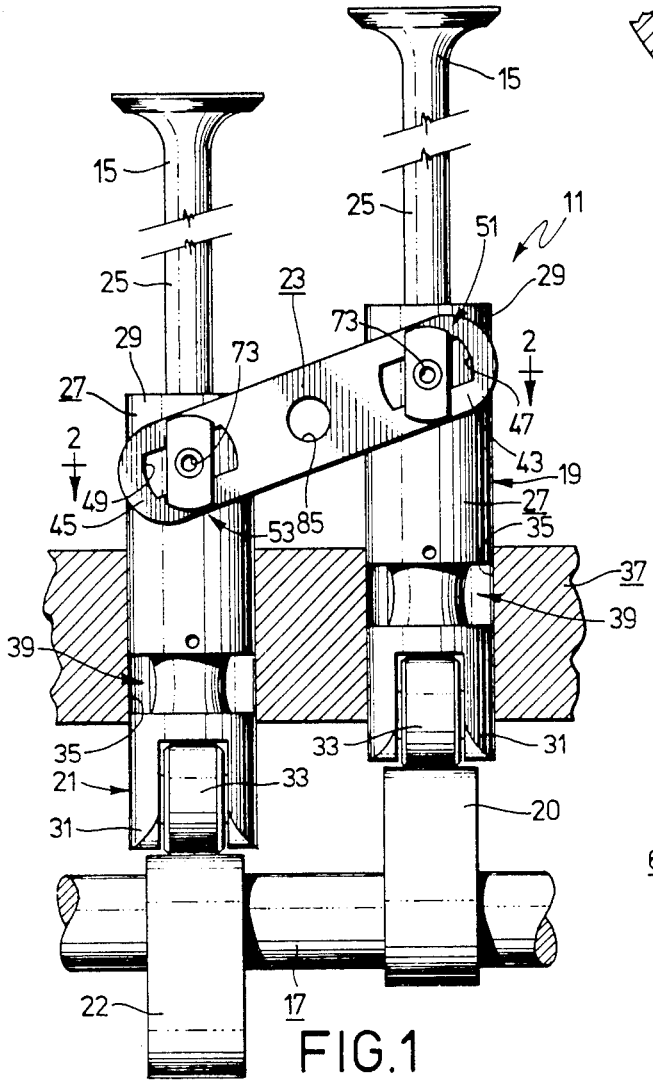
FIG. 1 is a somewhat diagrammatic side elevational view of the valve tappet apparatus of the present invention shown associated with a portion of an internal combustion engine.
Figure 3:
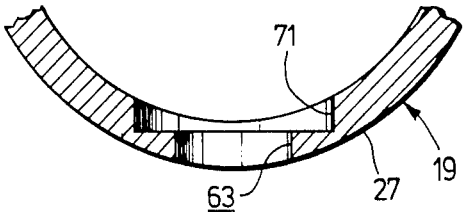
FIG. 3 is an enlarged sectional view of a portion of a tappet body of the valve tappet apparatus of the present invention.
Figure 4:
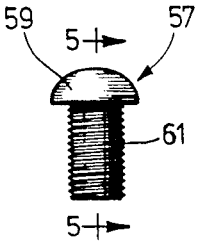
FIG. 4 is a side elevational view of a screw of an attachment means of the valve tappet apparatus of the present invention.
Figure 5:
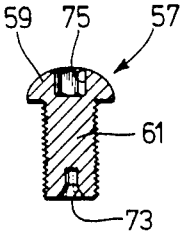
FIG. 5 is a sectional view substantially as taken on line V—V of FIG. 4.
Figure 6:
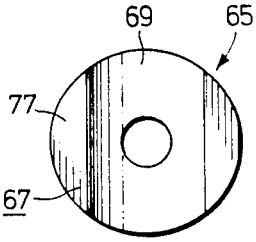
FIG. 6 is a rear elevational view of a nut of an attachment means of the valve tappet apparatus of the present invention.
Figure 7:
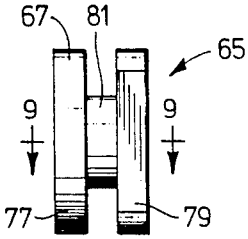
FIG. 7 is a side elevational view of the nut of FIG. 6.
Figure 8:
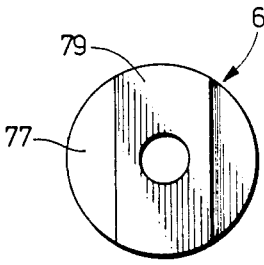
FIG. 8 is a front elevational view of the nut of Fig. 6.
Figure 9:
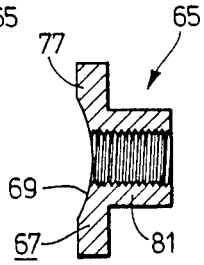
FIG. 9 is a sectional view substantially as taken on line IX—IX of FIG. 7.
Figure 2:
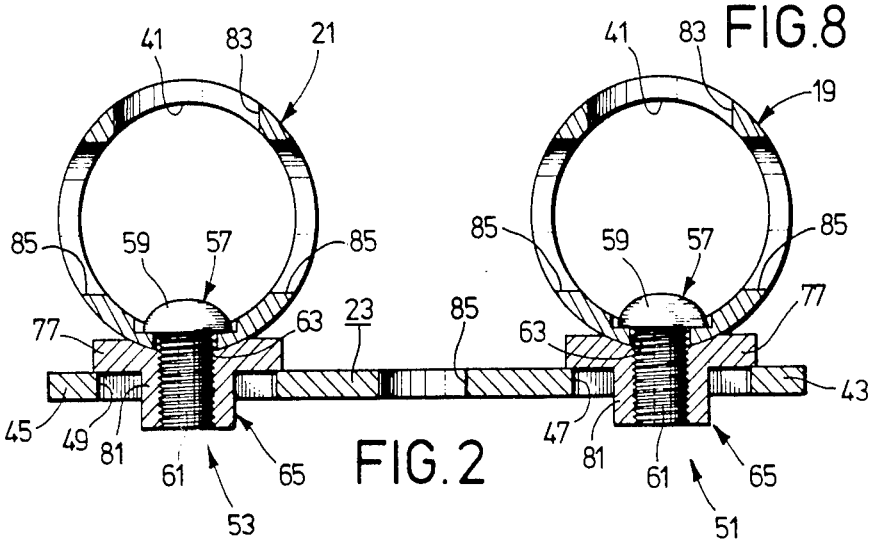
FIG. 2 is an enlarged sectional view substantially as taken on line II—II of FIG. 1 with portions thereof omitted for clarity.

The valve tappet apparatus 11 of the present invention is for use with an internal combustion engine having a plurality of valve members 15 and having cam means 17 for causing reciprocating movement of the valve members 15.

The apparatus 11 preferably includes a first tappet body 19 associated with one of the valve members 15 and with a first cam 20 of the cam means 17, a second tappet body 21 associated with an adjacent valve member 15 and with a second cam 22 of the cam means 17, and an elongated rigid link arm 23 extending between the first and second tappet bodies 19, 21 for preventing axial rotation of the first and second tappet bodies 19, 21 relative to the first and second cams 20, 22 respectively for reasons which will now be apparent to those skilled in the art.

The specific manner in which the first and second tappet bodies 19, 21 are associated with the respective valve members 15 may vary as will not be apparent to those skilled in the art. Thus, for example, typical tappet rod structure 25 or the like may extend from each tappet body 19, 21 to the associated valve member 15 as will now be apparent to those skilled in the art.

Each tappet body 19, 21 is preferably identical to one another and the following description of the first tappet body 19 will suffice for both with like features being identified by like numerals in the drawings.

At least a portion of the first tappet body 19 has a curved outer circumference. More specifically, the first tappet body 19 preferably consists in general of a cylindrical body 27 having a first end 29 and a second end 31. A roller 33 is rotatably mounted to the second end 31 of the body 27 in any typical manner now apparent to those skilled in the art for engaging the first cam 20 of the cam means 17. The body 27 is adapted to reciprocate in a bore 35 in the block 37 of the engine. Oil passageway structure 39 is preferably provided in the portion of the body 27 that reciprocates within the bore 35 to allow proper lubrication thereof in a manner as will now be apparent to those skilled in the art. A cylindrical bore 41 extends from the first end 29 of the body 27 along the longitudinal axis of the body 27 toward the second end 31 thereof for receiving the distal end of the tappet rod structure 25 or the like as will now be apparent to those skilled in the art.

The link arm 23 has a first end 43 for being attached to the first tappet body 19 and a second end 45 for being attached to the second tappet body 21. The link arm 23 preferably has a first slot 47 through the first end 43 thereof and a second slot 49 through the second end 45 thereof for allowing the link arm 23 to be attached to the respective tappet bodies 19, 21 in a manner as will hereinafter be described. The link arm 23 may be constructed in various manners and of various materials as will now be apparent to those skilled in the art such as, for example, by being machined out of metal.

The apparatus 11 includes a first attachment means 51 attaching the first end 43 of the link bar 23 to the first tappet body 19 and a second attachment means 53 attaching the second end 45 of the link bar 23 to the second tappet body 21. The first and second attachment means 51, 53 are preferably identical to one another and the following description of the first attachment means 51 will suffice for both with like features being identified by like numerals in the drawings.

The first attachment means 51 includes a screw 57 extending through at least a portion of the first tappet body 19. More specifically, the screw 57 preferably includes a head 59 and a body 61. The body 61 of the screw 57 extends through an aperture 63 in the wall of the first end 29 of the body 27 of the first tappet body 21. At least the distal end of the body 61 is preferably threaded. The first attachment means 51 also includes a nut 65 for coacting with the distal end of the body 61 of the screw 57 to attach the first end 43 of the link arm 23 to the first end 29 of the body 27 of the first tappet body 19. The nut 65 has a face side 67 for engaging a portion of the outer circumference of the first tappet body 19. The face side 67 of the nut 65 has a concaved portion 69 for engaging a portion of the outer circumference of the first tappet body 19. The curvature of the concaved portion 69 of the face side 67 of the nut 65 is preferably the same as the curvature of the outer circumference of the cylindrical body 27 of the first tappet body 19 to thereby increase the area of engagement between the nut 65 and the first tappet body 19 without requiring a flat or the like to be machined into the outer circumference of the cylindrical body 27 of the the outer circumference of the cylindrical body 27 of the first tappet body 19. Such a specifically limited construction will increase the strength of the connection between the first attachment means 51 and the first tappet body 19 as will now be apparent to those skilled in the art. The area of the interior wall of the body 27 about the aperture 63 is preferably counterbored as at 71 to receive the head 59 of the screw 57 and to increase the area of engagement between the head 59 of the screw 57 and the first tappet body 19 as will now be apparent to those skilled in the art. The distal end of the body 61 of the screw 57 preferably has a bore 73 therein for allowing the distal end of the body 61 of the screw 57 to be swagged onto the nut 65 to securely attach the nut 65 to the screw 57. More specifically, after the nut 65 has been screwed onto the body 61 of the screw 57 in any typical manner, a typical swagging tool or the like is used to swag the distal end of the body 61 of the screw 57 as will now be apparent to those skilled in the art. The head 59 of the screw 57 preferably has a hexagonal recess or socket 75 therein for allowing the screw 57 to be tightened onto the nut 65 with a typical allen wrench or the like.

The nut 65 preferably consists of a bobbin or button like structure having spaced first and second flanges 77, 79 joined by a cylinder 81. The outer face of the first flange 77 is the face side 67 of the nut 65 and has the concaved portion 69. The second flange 79 is preferably shaped to correspond with the slots 47, 49 through the ends 43, 45 of the link arm 23 to allow either end 43, 45 of the link arm 23 to be passed thereover as will hereinafter be described. The nut 65 may be constructed in various manners and of various materials as will now be apparent to those skilled in the art such as, for example, by being machined out of metal.

To use the apparatus 11, the attachment means 51, 53 are first attached to the respective tappet bodies 19, 21 by merely inserting a screw 57 through the aperture 63 in the first end 29 of the body 27 of the respective tappet body 19, 21 and into the respective nut. An aperture 83 may be provided through the wall of the first end 29 of the body 27 of the respective tappet body 19, 21 opposite the aperture 63 to facilitate access to the socket 75 in the head 59 of the screw 57 and to allow an allen wrench to be inserted therethrough for use in tightening the screw 57 onto the nut 65. Other apertures 85 may be provided through the tappet bodies 19, 21 and the link arm 23 to reduce the weight thereof, etc., for reasons which will now be apparent to those skilled in the art. Once the attachment means 51, 53 are securely attached to the respective tappet bodies 19, 21, the link arm 23 is attached to the respective attachment means 51, 53 by merely passing the respective slots 47, 49 over the respective flange 79. The link arm 23 is then rotated so the longitudinal axis of the respective slots 47, 49 is out-of-align with the longitudinal axis of the respective flange 79 to thereby prevent inadvertent removal of the link bar 23 from the respective attachment means 51, 53. The first and second tappet bodies 19, 21 can be then inserted into adjacent bores 35 and the tappet rod structure 25 can be coupled thereto. It will be noted that when in normal operation, the longitudinal axes of the respective slots 47, 49 will never align with the longitudinal axes of the respective flanges 79 whereby the link arm 23 will remain attached to the respective tappet bodies 19, 21 during normal operation of the engine and will prevent longitudinal rotation of the respective tappet bodies 19, 21.

Although the present invention has been described and illustrated with respect to a preferred embodiment and a preferred use therefor, it is not to be so limited since modifications and changes can be made therein which are within the full intended scope of the invention.

We claim:

1. A valve tappet apparatus for use with an internal combustion engine having a plurality of valve members and cam means for causing reciprocating movement of said valve members, said apparatus comprising:

(a) a first tappet body associated with one of said valve members and with said cam means, at least a portion of said first tappet body having a curved outer circumference:

(b) a second tappet body associated with another of said valve members and with said cam means. at least a portion of said second tappet body having a curved outer circumference;

(c) an elongated, rigid link bar having a first end and a second end;

(d) a first attachment means attaching said first end of said link bar to said first tappet body, said first attachment means including a screw for extending through at least a portion of said first tappet body, said first attachment means including a nut member for attaching said first end of said link bar to the distal end of said screw of said first attachment means, said nut member having a face side for engaging said outer circumference of said first tappet body, said face surface of said nut member having a concaved portion for engaging a portion of said outer circumference of said first tappet body; and (e) a second attachment means attaching said second end of said link bar to said second tappet body, said second attachment means including a screw for extending through at least a portion of said second tappet body, said second attachment means including a nut member for attaching said second end of said link bar to the distal end of said screw of said second attachment means, said nut member having a face side for engaging said outer circumference of said second tappet body, said face surface of said nut member having a concaved portion for engaging a portion of said outer circumference of said second tappet body.

2. The apparatus of claim 1 in which the curvature of said concaved portion of said face surface of said nut members of said first and second attachment means is the same as the curvature of said outer circumference of the respective one of said tappet bodies to thereby increase the area of engagement therebetween.

3. The apparatus of claim 2 in which said first tappet body includes a cylindrical body having a first end and a second end; in which a roller is rotatably mounted to said second end of said cylindrical body of said first tappet body for engaging a first cam of said cam means; in which said cylindrical body of said first tappet body has a cylindrical bore extending from said first end thereof along the longitudinal axis thereof toward said second end thereof for being associated with one of said valve members.

4. The apparatus of claim 3 in which said second tappet body includes a cylindrical body having a first end and a second end; in which a roller is rotatably mounted to said second end of said cylindrical body of said second tappet body for engaging a second cam of said cam means; in which said cylindrical body of said second tappet body has a cylindrical bore extending from said first end therof along the longitudinal axis thereof toward said second end thereof for being associated with another of said valve members.

5. The apparatus of claim 2 in which said link arm has a first slot through said first end thereof and a second slot through said second end thereof for allowing said first and second ends of said link arm to be attached to said first and second tappet bodies, respectively.

6. The apparatus of claim 5 in which said screw of said first attachment means includes a head and a body; in which said first end of said first tappet body has an aperture therethrough for allowing said body of said screw of said first attachment means to extend therethrough; in which at least the distal end of said body of said screw of said first attachment means is threaded; in which said first attachment means includes a nut for coacting with the threaded distal end of said body of said screw of said first attachment means to attach said first end of said link arm to said first end of said body of said first tappet body.

7. The apparatus of claim 6 in which an area of the interior wall of said body of said first tappet body about said aperture has a counterbored portion to receive said head of said screw of said first attachment means and to increase the area of engagement between said head of said screw of said first attachment means and said first tappet body.

8. The apparatus of claim 7 in which the distal end of said body of said screw of said first attachment means has a bore therein for allowing said distal end thereof to be swagged onto said nut of said first attachment means to securely attach said nut of said first attachment means to said screw of said first attachment means.

9. The apparatus of claim 8 in which said nut of said first attachment means has spaced first and second flanges joined by a cylinder.

10. The apparatus of claim 9 in which said second flange of said nut of said first attachment means is shaped to correspond with said slot through said first end of said link arm to allow said first end of said link arm to be passed thereover.

11. The apparatus of claim 5 in which said screw of said second attachment means includes a head and a body; in which said first end of said second tappet body has an aperture therethrough for allowing said body of said screw of said second attachment means to extend therethrough; in which at least the distal end of said body of said screw of said second attachment means is threaded; in which said second attachment means includes a nut for coacting with the threaded distal end of said body of said screw of said second attachment means to attach said second end of said link arm to said first end of said body of said second tappet body.

12. The apparatus of claim 11 in which an area of the interior wall of said body of said second tappet body about said aperture has a counterbored portion to receive said head of said screw of said second attachment means and to increase the area of engagement between said head of said screw of said second attachment means and said second tappet body.

13. The apparatus of claim 12 in which the distal end of said body of said screw of said second attachment means has a bore therein for allowing said distal end thereof to be swagged onto said nut of said second attachment means to securely attach said nut of said second attachment means to said screw of said second attachment means.

14. The apparatus of claim 13 in which said nut of said second attachment means has spaced first and second flanges joined by a cylinder.

15. The apparatus of claim 14 in which said second flange of said nut of said second attachment means is shaped to correspond with said slot through said second end of said link arm to allow said second end of said link arm to be passed thereover.

* * * * *